US006068447A

United States Patent [19]

Foege

[11] Patent Number: 6,068,447

[45] Date of Patent: May 30, 2000

[54] SEMI-AUTOMATIC COMPRESSOR CONTROLLER AND METHOD OF CONTROLLING A COMPRESSOR

[75] Inventor: Robert L. Foege, Newtown, Conn.

[73] Assignee: Standard Pneumatic Products, Inc., Newtown, Conn.

[21] Appl. No.: 09/108,334

[22] Filed: Jun. 30, 1998

[51] Int. Cl.[7] ..... F04B 49/00

[52] U.S. Cl. ..... 417/12; 417/13

[58] Field of Search ..... 417/12, 13, 18, 417/38, 29, 9

[56] References Cited

U.S. PATENT DOCUMENTS

| | | | |
|---|---|---|---|
| 1,068,122 | 7/1913 | Goehring . | |
| 1,521,034 | 12/1924 | Maxson . | |
| 1,980,799 | 11/1934 | Hardesty . | |
| 2,267,959 | 12/1941 | Teach . | |
| 3,232,519 | 2/1966 | Long | 417/13 |
| 4,149,827 | 4/1979 | Hofmann, Jr. | 417/12 |
| 4,201,517 | 5/1980 | Ferguson | 417/12 |
| 4,293,281 | 10/1981 | Lamoreaux | 417/9 |
| 4,432,698 | 2/1984 | Shirakuma et al. | 417/27 |
| 4,443,156 | 4/1984 | Dunnam, Jr. | 417/12 |
| 4,453,893 | 6/1984 | Hutmaker | 417/279 |
| 4,863,355 | 9/1989 | Odagiri et al. | 417/12 |
| 4,990,057 | 2/1991 | Rollins | 417/12 |
| 5,035,582 | 7/1991 | Carroll et al. | 417/44 |
| 5,692,540 | 12/1997 | Huang | 137/624.11 |

OTHER PUBLICATIONS

Hobbes Corporation (HTTP://www.thomasregister.com/olc/hobbscorp/page9.htm).

Groundtek Manufacturing (HTTP://www.gourndtek.com/gtpg3.htm), May 1999.

W. W. Grainger, Inc, General Catalog No. 380, p1636, Dec. 1991.

*Primary Examiner*—Timothy S. Thorpe
*Assistant Examiner*—David J. Torrente
*Attorney, Agent, or Firm*—St. Onge Steward Johnston & Reens LLC

[57] ABSTRACT

The present invention provides a controller for an air compressor system. The air compressor system includes an air compressor, control unloaders on the air compressor to prevent the air compressor from compressing gases when signaled to unload, an electric motor for driving the air compressor, and a tank for receiving and storing compressed gases from the air compressor. The controller has an adjustable pressure switch to raise or lower the discharge pressure. The differential pressure is pre-set in the pressure switch. The controller includes two methods of operating the air compressor, each of which is manually selected by operating a switch that will designate start/stop control or automatic dual control at the option of the operator. The start/stop control will start the motor when the pressure in the system reaches a predetermined low point. When the preselected high pressure point is reached, a signal is sent to the motor to stop, thereby ending the compressing cycle. When the automatic dual control mode is selected and when the high pressure point is reached, the compressor unloaders are actuated, the motor continues to run and the compressor operates in the unloaded or idling mode. When the aforementioned unloaders are actuated, the unloader time accumulates and times the manually set idle period the compressor will run before shutting down the motor. If during the idle time the system pressure drops to the preselected low point, the unloaders are disabled and the compressor begins to pump to satisfy the compressed air load requirement. The controller also includes a power on/off switch, a running timer, an emergency shutdown with indicator light with remote signaling capability, and an autodrain feature based upon production of compressed air. The controller is adaptable to both rotary screw and reciprocating air compressors.

14 Claims, 5 Drawing Sheets

SEMI-AUTOMATIC COMPRESSOR CONTROLLER AND METHOD OF CONTROLLING A COMPRESSOR

FIELD OF THE INVENTION

This invention generally relates to a compressor controller and a method for controlling the operation of a compressor.

BACKGROUND OF THE INVENTION

Compressor systems generally include a compressor for compressing gases such as air for example, a tank for receiving and storing the compressed gas, and a motor for driving the compressor. In use, compressed gas is released from the tank for such purposes as spraying paint, inflating automobile tires, or powering pneumatic tools. Normally, the compressor automatically starts and stops according to the demand of the system. When the pressure in the tank drops to a pre-selected lower level, the compressor starts in order to refill the tank, and when the tank pressure reaches a pre-selected upper level, the compressor stops.

Operation of the compressor to produce compressed gas is usually controlled by one of two methods. First, in a start/stop control mode, the motor driving the compressor is automatically enabled and disabled in response, respectively, to pre-selected lower and pre-selected upper pressure levels in the tank. Second, in a load/unload control mode, the motor is continuously run but the compressor is loaded and unloaded automatically in response, respectively, to pre-selected lower and upper pressure levels in the tank. As is known, an unloader opens a valve and/or closes an intake port to prevent the compressor from compressing gases. Thus, when unloaded, the compressor continues to run with only friction losses but no pressure is produced, such that compressor and motor wear are minimal.

Under light load conditions, i.e. light and/or infrequent demand for compressed gas, the start/stop control mode is preferable. Light load conditions are characterized by short run periods for the compressor followed by a relatively long period in which the tank does not require additional compressed gas. By stopping the motor instead of unloading the compressor, motor and compressor wear are reduced and no power is consumed during the period that the compressor is not required to run.

The load/unload control mode, in contrast, is preferable under heavy load conditions, i.e. heavy and/or frequent demand for compressed gas. Under heavy load conditions, the compressor is required to start and stop frequently and to run for extended periods. Since most motors are very inefficient during start-up, attempts to control the compressor by starting and stopping the motor result in an increased energy consumption due to the frequent starts and may possibly lead to motor damage. In contrast, if an unloader is used to control the compressor, the unloaded compressor requires little power input during the relatively short unloaded periods, and the continuous operation of the motor during the unloaded period generally requires less energy than a restart of the motor. Thus, the load/unload control mode is more efficient and economical under heavy load conditions.

Some compressors, however, operate under both heavy and light load conditions. In such cases, the compressor is usually provided with both a start/stop control mode and an unloader control mode. Selection between the control modes can be provided manually or automatically.

U.S. Pat. No. 4,863,355 to Odagiri et al. and U.S. Pat. No. 4,201,517 to Ferguson, for example, both generally disclose a control that automatically selects between a start/stop and a load/unloaded mode based upon the rate of change of tank pressure.

U.S. Pat. No. 1,521,034 to Maxson discloses a compressor control that provides a modified load/unload control mode wherein the control stops the motor after a fixed period if the rate of change of pressure is low.

U.S. Pat. No. 4,149,827 to Hofmann, Jr. discloses a method providing automatic selection of the mode of operation. Depending on the rate of change of tank pressure, the compressor operates in a start/stop, loaded/unloaded, or a "regulated" mode. In the regulated mode, the compressor intake is varied between open and closed.

U.S. Pat. No. 4,453,893 to Hutmaker discloses a drainage control for a compressor system. The control automatically purges a compressor tank of the system each time the compressor is shut off.

What is desired, however, is a controller for a compressor system that provides a start/stop control mode that allows a compressor of the system to run unloaded for a pre-selected selected period after a motor of the system is started. In addition, it is desired to have a controller that provides a load/unload control mode wherein a motor of the system is automatically stopped after a manually selected period after a compressor of the system is unloaded. It is also desired to have a controller providing these features plus an emergency stop feature wherein a motor of the system is stopped upon the controller receiving an indication that a compressor is operating improperly, or a recording of cumulative operating time feature, or an automatic tank drain feature based upon cumulative operating time.

SUMMARY OF THE INVENTION

A general object of the present invention, accordingly, is to provide a controller for a compressor system that controls a motor and a compressor of the system.

A more specific object of the present invention is to provide a controller for a compressor system that allows a selection between a start/stop control mode and a load/unload control mode.

Another object of the present invention is to provide a controller for a compressor system that provides a start/stop control mode that allows a compressor of the system to run unloaded for a manually selected period after a motor of the system is started.

An additional object of the present invention is to provide a controller for a compressor system that provides a load/unload control mode, wherein a motor of the system is automatically stopped after a pre-selected period after a compressor of the system is unloaded.

A further object of the present invention is to provide a controller for a compressor system that automatically stops a motor of the system when pre-determined operating conditions are meet.

Still another object of the present invention is to provide a controller for a compressor system that provides a record of operating time of a compressor of the system.

A yet further object of the present invention is to provide a controller for a compressor system that automatically drains a tank of the system after a pre-selected operating period of a compressor of the system.

Still a further object of the present invention, is to provide a controller for a compressor system meeting all of the above objects, among others, yet provided in a compact package easily mounted to a new or existing compressor system.

The present invention meets these and other objects by providing a controller for a compressor system including a compressor, a motor for driving the compressor, an unloader for preventing the compressor from compressing gases, and a tank for receiving and storing compressed gases from the compressor. The controller includes a start/stop control for starting the motor upon an internal pressure of the tank falling below a pre-selected low pressure level, and for stopping the motor upon the internal pressure of the tank rising above a pre-selected high pressure level, the start/stop control enabling the unloader for a pre-selected delay period after starting the motor, and a load/unload control for disabling the unloader upon the internal pressure of the tank falling below the pre-selected low pressure level, and for enabling the unloader upon the internal pressure of the tank rising above the pre-selected high pressure level, the load/unload control configured to stop the motor at the expiration of an unload period after enabling the unloader. The controller also includes a selector for selecting either the start/stop control or the load/unload control, and a selector for allowing a user to select the unload period.

According to one aspect of the present invention, the controller further includes a drain control for opening a drain of the tank upon a pre-selected operating time of the compressor.

According to another aspect of the present invention, the controller further includes a recorder for recording cumulative operating time of the compressor.

According to an additional aspect of the present invention, the controller stops the motor upon receiving an indication that the compressor is malfunctioning.

The present invention also provides a method for controlling a compressor system. The method includes measuring an internal pressure of the tank, operating the compressor in either a start/stop mode or a load/unload mode, recording the cumulative operating time of the compressor, and draining the tank at pre-selected intervals of cumulative operating time. During the start/stop mode, the unloader is disabled and the motor is started upon the internal pressure of the tank falling below a pre-selected low pressure level and stopped upon the internal pressure of the tank rising above a pre-selected high pressure level. During the load/unload mode, the motor is allowed to run and the unloader is disabled upon the internal pressure of the tank falling below the pre-selected low pressure level, and enabled upon the internal pressure of the tank rising above the pre-selected high pressure level.

According to one aspect of the present invention, the start/stop operating mode includes enabling the unloader for a pre-selected delay period after the motor is started.

According to another aspect of the present invention, the load/unload operating mode includes stopping the motor at a pre-selected unloading period after the unloader is enabled.

According to an additional aspect of the present invention, the method further includes allowing a user to set the unloading period when the compressor is operated in the load/unload mode.

According to a further aspect of the present invention, the method includes stopping the motor upon receiving an indication that the compressor is malfunctioning.

The invention and its particular features and advantages will become more apparent from the following detailed description considered with reference to the accompanying drawings.

DETAILED DESCRIPTION OF THE INVENTION

Figure 1:
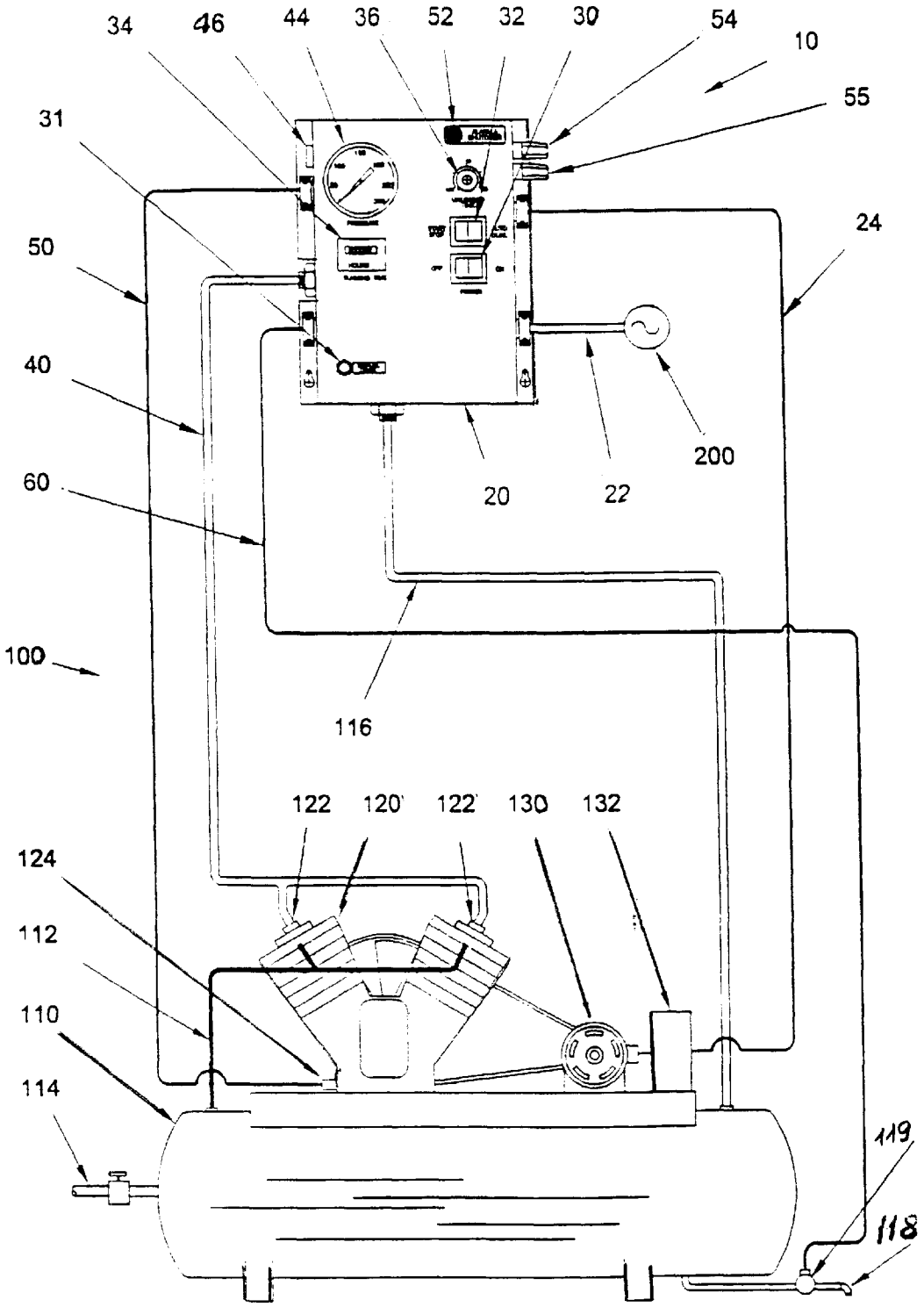
FIG. 1 is a front plan view of a semi-automatic controller according to the present invention shown connected to a schematic representation of a compressor system.

Referring to FIG. 1, the present invention provides a semi-automatic controller 10 for a compressor system 100. As is known, a compressor system 100 generally includes a tank 110, a compressor 120 and an electric motor 130. The electric motor 130 drives the compressor 120, which compresses gases that are then stored in the tank 110. The stored, compressed gases in the tank 110 can be used for driving or powering various outputs or loads, such as a spray-paint gun or a pneumatic tool for example.

The tank 110 includes an input air conduit 112 connected to the compressor 120, an output conduit 114 for connection to a load, a pressure-monitoring conduit 116 and a drain conduit 118. The drain conduit 118 is for periodically emptying the tank 110 to remove moisture and contaminants, and includes a solenoid valve 119.

The compressor 120 includes mechanical unloaders 122 for controlling the output of the compressor. Although the compressor 120 when enabled is still being driven by the electric motor 130, the unloaders 122 open the compressor valves and/or close the compressor intake such that compression cannot occur. Since a gas is not being compressed, it is only necessary for the electric motor 130 to overcome friction losses in order to drive the compressor 120. Thus, the compressor system 100 operates at a minimal load when the unloaders 122 are enabled.

The unloaders 122 normally sense pressure in the tank 110 through the pressure-monitoring conduit 116. When tank pressure drops to a pre-selected low level, the unloaders 122 are disabled such that compression can occur. When tank pressure rises to a pre-selected high level, the unloaders 122 are enabled such that compression cannot occur. In this manner, the internal pressure of the tank 110 is maintained between the pre-selected low and high levels without having to start and stop the motor 130.

The compressor 120 can also include a sensor switch 124 for sensing operating conditions within the compressor, such as oil pressure, oil level, and/or gas temperature. The sensor switch 124 would normally be connected to the motor 130, such that if the sensor switch sensed unwanted operating conditions, such as low oil pressure and/or high air temperature, it would open to stop the motor and prevent damage to the motor and the compressor.

The electric motor 130 includes a magnetic starter coil 132 that would normally be connected to an electrical power source 200 by a main electrical conductor 22. As its name implies, the magnetic starter coil 132 starts the motor 130 when power is supplied through the main electrical conductor 22.

The semi-automatic compressor controller 10 according to the present invention allows a user to select between either a modified start/stop control mode or a modified load/unload control mode for the compressor system 100, as discussed in greater detail below. The controller 10 intersects the main electrical conductor 22 and the pressure-monitoring line 116, such that the controller controls both the electric motor 130 and the unloaders 122.

The controller 10 is advantageously self-contained in a metal or plastic electrical cabinet 20, such that it can easily be mounted onto the compressor system 100 during initial manufacture of the system or retrofitted to an existing system. The main electrical conductor 22 extends into the cabinet 20 from the electrical power source 200, while a secondary electrical conductor 24 extends from within the cabinet to the motor starter coil. Both conductors 22, 24 are connected to a circuit board contained within the cabinet 20. In addition, all valves and switches of the controller are connected to the circuit board. Although the circuit board is not shown, the control modes carried out by the circuit board are described in detail below and by the flow charts of FIGS. 3 through 6.

The controller 10 includes an on/off (or main power) rocker switch 30 and a start/stop-automatic dual control rocker switch 32. The on/off switch 30 is preferably a lighted switch such that it becomes illuminated when pushed to the on position. A cumulative operating time recorder 34 is provided for recording cumulative operating time whenever the air compressor is running. The controller 10 also includes an unload time dial 36 which can be manually set when the start/stop-automatic dual control switch 32 is pushed to the automatic dual control position.

Figure 2:
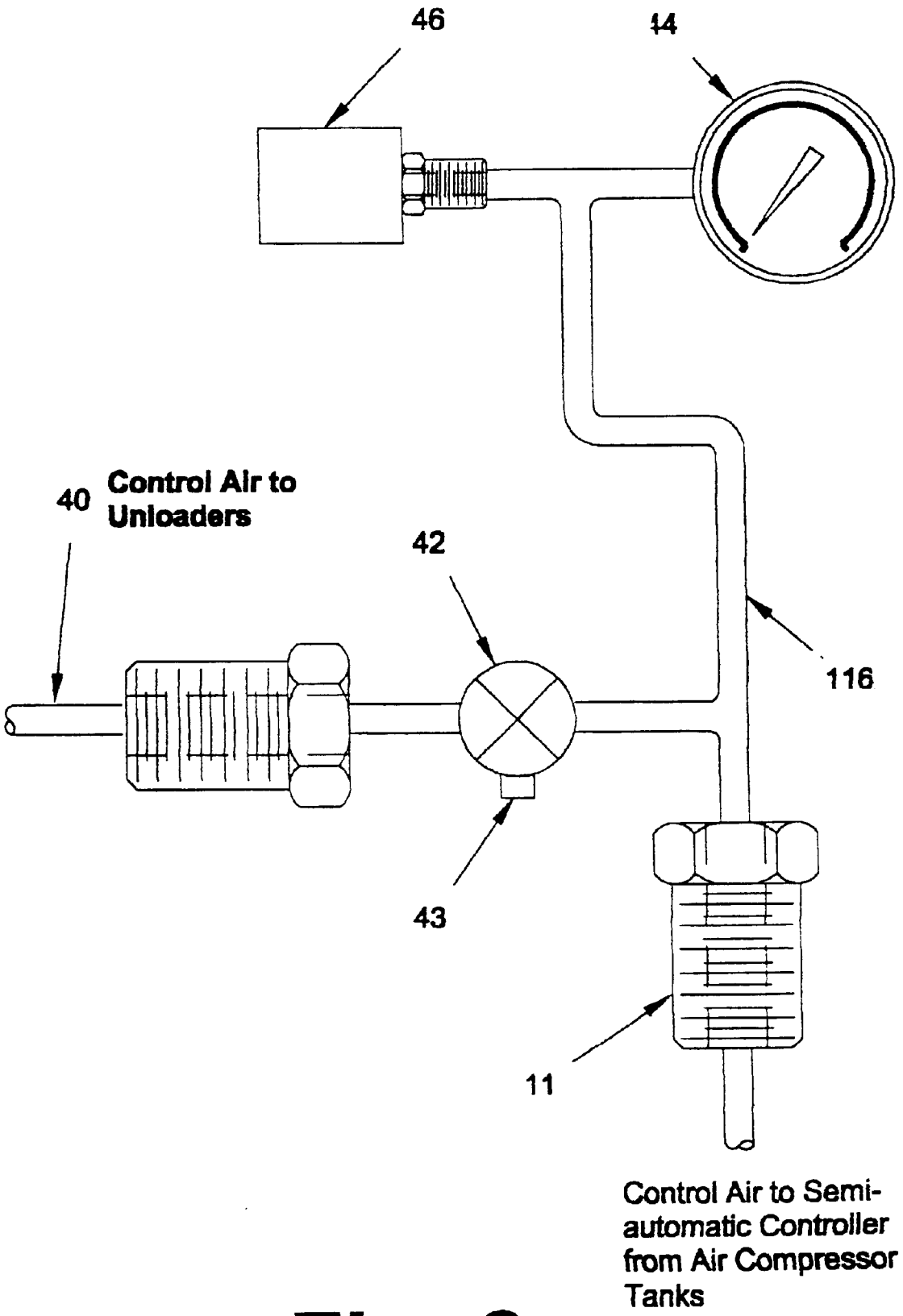
FIG. 2 is a somewhat simplified schematic of the pneumatic connections of the controller of FIG. 1.

As also shown in FIG. 2, the pressure-monitor conduit 116 extends from the tank 110 to within the cabinet 20 of the controller 10 while an unloader-control conduit 40 extends from within the cabinet to the unloaders 122 of the compressor 120. An unloader-control three-way solenoid valve 42 connects the pressure-monitor conduit 116 and the unloader-control conduit 40.

When the tank pressure reaches the preselected high pressure point the pressure switch 46 signals the solenoid valve to open enabling the unloaders. A gauge 44 is connected directly to the pressure-monitor conduit 116 for displaying the tank pressure. Preferably, the gauge 44 is liquid-filled to provide needle stability.

In addition, an adjustable pressure switch 46 is also directly connected to the pressure-monitor conduit 116. The pressure switch 46 cycles on upon sensing a pre-selected high tank pressure, and cycles off upon sensing a low pressure that is a pre-selected differential. The adjustable pressure switch 46 controls the 3-way solenoid valve 42 which is normally open. The solenoid valve 43 closes on actuation of pressure switch 46 and relieves pressure from the unloaders through the control air dump 43 which exhausts the control air to the atmosphere. The pre-selected cycle settings of the pressure switch 46 are normally set during manufacture of the controller 10. However, the pressure switch 46 can be field adjusted and is accessible through a hole in the cabinet 20. Preferable pressure cycle settings may include 85–110 psi, 100–125 psi, 125–150 psi, or 150–175 psi, for example, or anything in between.

A conductor 50 extends from the compressor emergency shut down switch 124, into the cabinet 20 of the controller 10 and is connected to the controller circuit board. As discussed in further detail below, the circuit board stops the motor 130 when the sensor switch 124 switches off due to an unwanted operating condition, such as a low oil pressure, low oil level, or a high air temperature within the compressor 120. The controller 10 includes an indicator light 52 and a set of positive and negative signal connectors 54, 55, all of which are connected to the controller circuit board. When the motor 130 is stopped due to unwanted operating conditions, the circuit board causes the indicator light 52 to flash to indicate that the controller 10 has initiated an emergency shutdown of the compressor system 100. In addition, signal wires from a remote monitoring station can be connected to the signal connectors 54, 55 to provide a remote indication of emergency shutdown.

A drain control conductor 60 extends from the circuit board within the cabinet 20 and is connected to the drain solenoid valve 119. Thus, the controller 10 also controls the drain valve 119 as discussed in further detail below.

Figure 3:
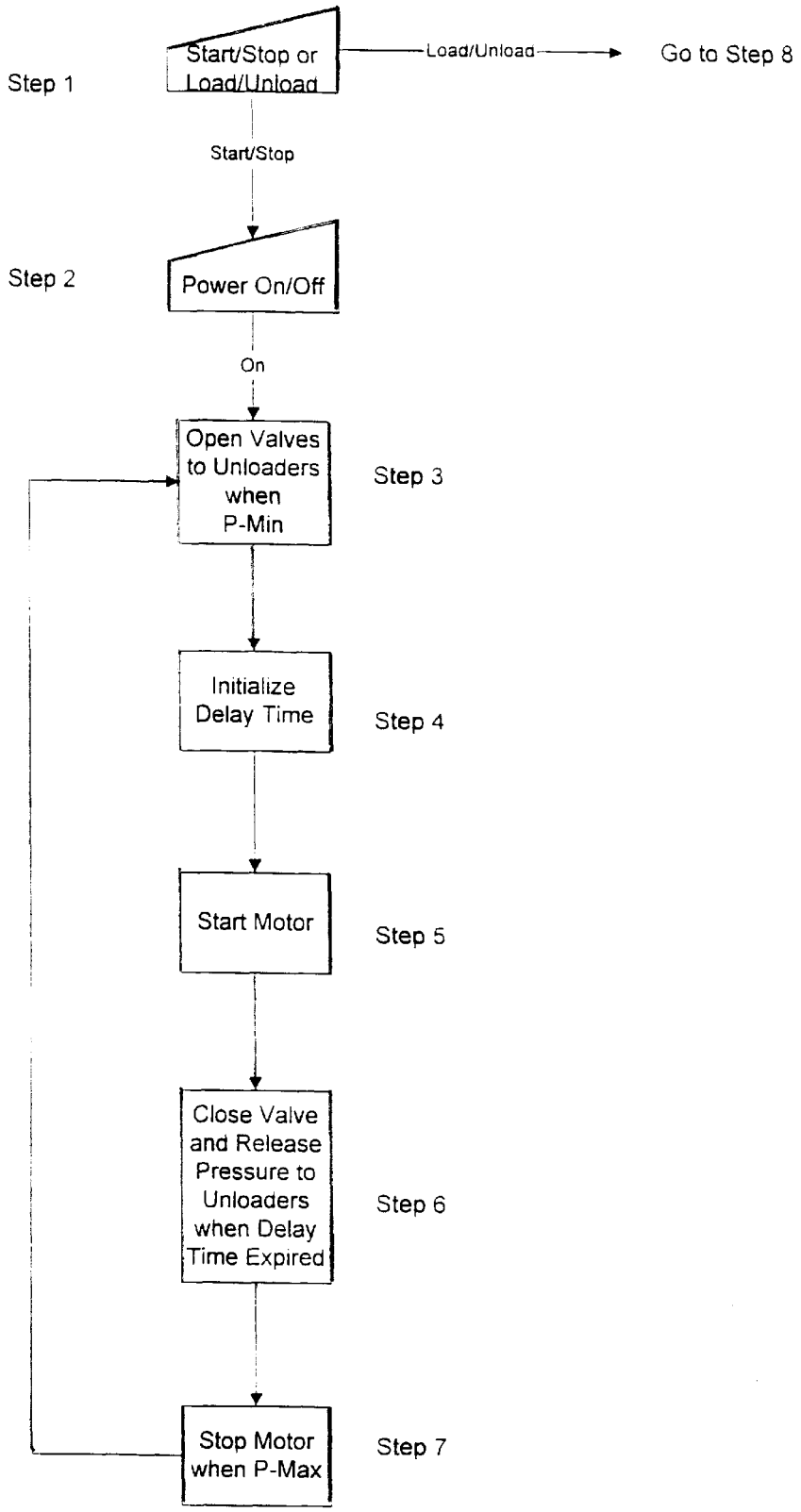
FIG. 3 is a flow chart of a modified start/stop control mode of the controller of FIG. 1.
Figure 4:
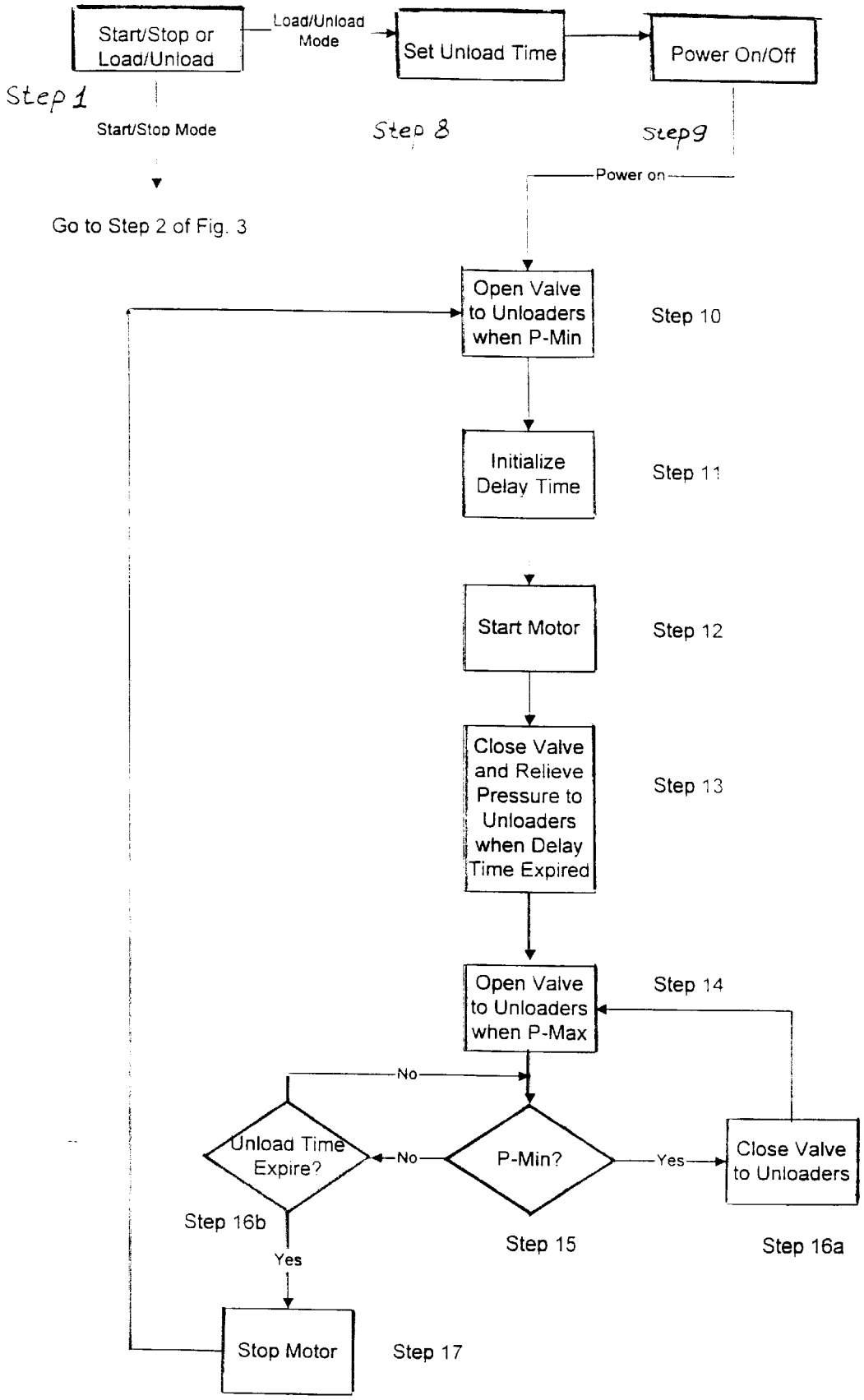
FIG. 4 is a flow chart of an automatic dual control mode of the controller of FIG. 1.

FIGS. 3 and 4 show flow-charts representing the modified start/stop control mode and the automatic dual control mode carried out by the controller 10. Both control modes begin at step 1, when, using the start/stop-automatic dual control switch 32, a user selects which control mode the controller 10 should carry out.

Referring to FIG. 3, if the start/stop-automatic dual control switch 32 is pushed to the start/stop position, then a user simply has to switch the power on, at step 2, using the on/off switch 30. In general, a start/stop control mode simply disables the unloaders 122, and starts and stops the motor 130 in response to tank 110 pressure. There is always a five (5) second automatic initial unload delay on start-up to effect a perfectly unloaded motor start. The start/stop control mode is preferable during light demand conditions, which is characterized by short run periods for the compressor 120 followed by a relatively long period in which the tank 110 does not require additional compressed gas. By stopping the motor 130 instead of unloading the compressor 120, motor and compressor wear are reduced and no power is consumed during periods when the motor is not required to run.

At step 3, if the pressure switch 46 monitoring the tank pressure cycles on upon sensing the pre-selected low tank pressure, the motor 130 is started to power the compressor 120 to provide additional compressed gases to the tank 110. The controller 10 according to the present invention, however, provides a modified start/stop control mode. Before the motor 130 is started, the unloader control valve 42 is opened such that the unloaders 122 can be enabled so that the compressor 120 will initially run unloaded. At step 4 a delay time, which is preferably equal to five (5) seconds, is initialized by the controller 10, and at step 6 the motor 130 is started. Step 4 and step 5 occur essentially simultaneously. Once the delay time has expired at step 6, the unloader control valve 42 is closed and pressure to the unloaders is released so that the unloaders 122 are disabled. Thus, whenever the motor 130 is started by the controller 10 of the present invention, the compressor 120 is run initially unloaded for a delay period of five (5) seconds. The unloaded delay period allows oil pressure to rise within the compressor 120 before the compressor is loaded, thereby protecting the compressor and the motor 130 from unnecessary wear and tear during start-up. This system eliminates the requirement for any mechanical or other electrical unloader mechanisms installed on the air compressor pump or system.

At step 10, when the pressure switch 46 cycles off upon sensing the pre-selected high tank pressure, the motor 130 is stopped. The controller then returns to step 3 to repeat the start/stop control mode until the on/off switch 30 is toggled to the off position.

Referring to FIG. 4, if the start/stop-automatic dual control switch 32 is toggled to the automatic dual control position at step 1, then a user is allowed to set an unload time at step 8 using the unload time dial 36 before toggling the on/off switch 30 to the on position at step 9. The automatic dual control mode is generally a modified load/unload control mode. A load/unload control mode simply starts the motor 130, and enables and disables the unloaders 122 in response to tank pressure. As is known, the load/unload mode is preferable during heavy demand conditions, i.e. heavy and/or frequent demand for compressed gas. Under heavy load conditions, the compressor is required to start and stop frequently and to run for extended periods. Since most motors are very inefficient during start-up, attempts to control the compressor by starting and stopping the motor result in an increased energy consumption due to the frequent starts and may possibly lead to motor damage. In contrast, if the unloaders are used to control the compressor, the unloaded compressor requires little power input during the relatively short unloaded periods. The continuous operation of the motor during the unloaded period requires less energy than a restart of the motor. Thus, the load/unload control mode is more efficient and economical under heavy load conditions.

The automatic dual control mode according to the present invention, however, allows the input of an unload time at step 8. The unload time dial 36 allows a user to select an unloaded time, preferably between three (3) and twenty (20) minutes, that the motor 130 will be allowed to run with the unloaders 122 enabled. Once the unloaded run period has expired, the motor 130 will be shut off. This feature prevents problems associated with long unloaded run times, such as high electrical costs to continuously run the motor 130, oil being pumped out of the crank-case of the compressor 120, glazing of compressor cylinder surfaces, overheating of the compressor, and excessive wear on running parts for example.

At step 10, if the pressure switch 46 cycles on upon sensing the pre-selected low tank pressure, the motor 130 is started to power the compressor 120. Before the motor 130 is started, however, the unloader control valve 42 is opened to allow the unloaders 122 to be enabled such that the compressor 120 will initially run unloaded. At step 11 a delay time, which is preferably equal to five (5) seconds, is initialized by the controller 10, and at step 16 the motor 130 is started. Steps 11 and 12 occur essentially simultaneously. Once the delay time has expired at step 13, the unloader control valve 42 is closed and the pressure to the unloaders is released such that the unloaders 122 are disabled. Thus, the unloaded delay period again allows oil pressure to rise within the compressor 120 before the compressor is loaded, thereby protecting the compressor and the motor 130 from unnecessary wear and tear during start-up.

At step 13, if the pressure switch 46 cycles off upon sensing the pre-selected high tank pressure, the unloader control valve 42 is opened at step 20 so that the unloaders 122 may be enabled to stop the compressor 120 from compressing gases. At step 15, if the pressure switch 46 cycles on upon sensing the pre-selected low tank pressure, the unloader control valve 42 is closed at step 16*a* such that the unloaders 122 are disabled so the compressor 120 can resume compressing gases to fill the tank 110. From step 16*a* the controller returns to step 14.

If, however, at step 15, the pressure switch 46 does not sense the pre-selected low tank pressure, the control mode moves to step 16*b*. If the pre-selected low tank pressure has not been reached at step 15 and the unload time has expired at step 16*b*, then the motor 130 is stopped at step 17. The controller 10 then repeats the automatic dual control mode by returning to step 10 until the on/off switch is toggled off.

Figure 5:
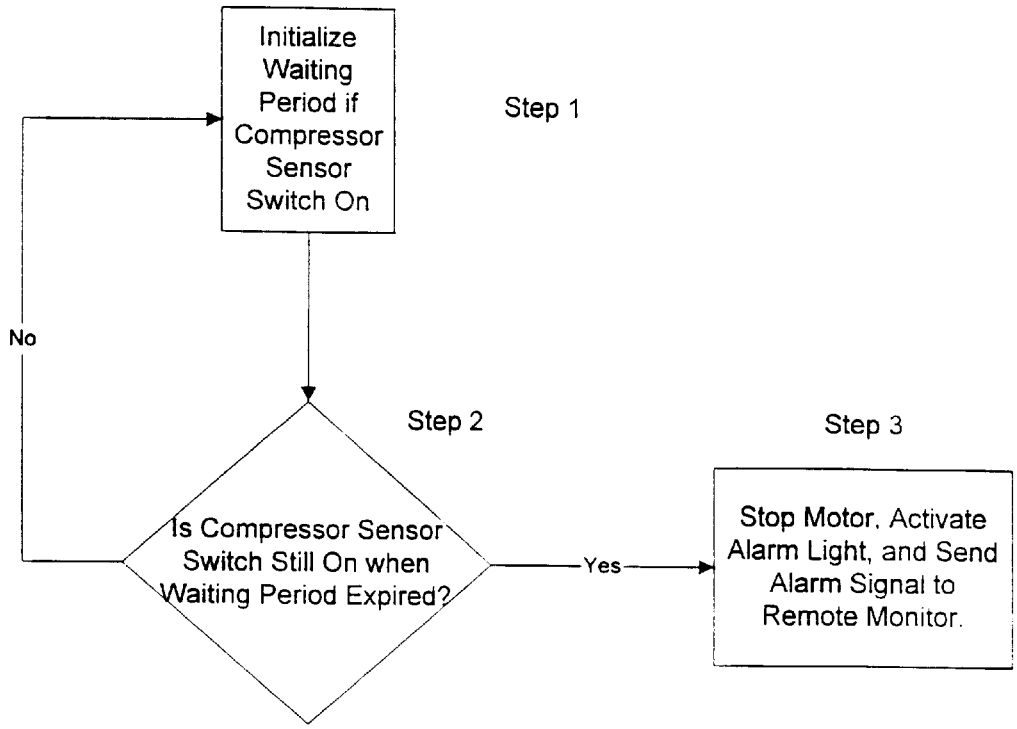
FIG. 5 is a flow chart of an emergency shut-down feature of the controller of FIG. 1.
Figure 6:
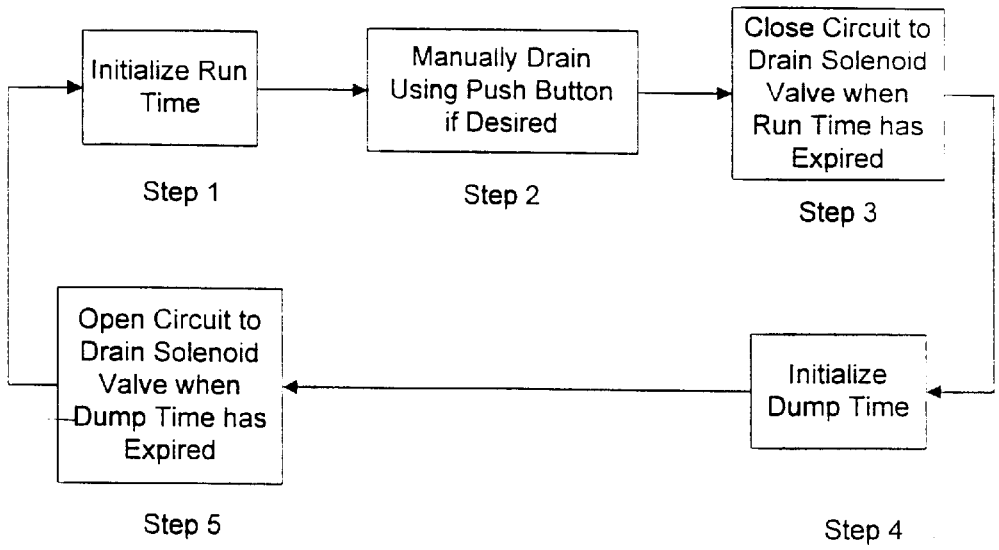
FIG. 6 is a flow chart of an automatic drain feature having a manual override of the controller of FIG. 1.

Referring now to FIGS. 5 and 6, the controller 10 also provides an emergency stop feature and an automatic drain feature. FIG. 5 illustrates the emergency stop feature carried out by the controller 10. First, at step 1, if the compressor sensor switch 124 is off due to sensing an unwanted operating condition, the controller 10 initializes a waiting period. The waiting period is preferably equal to about twenty (20) seconds. At step 2, if the waiting period has expired and the compressor sensor switch 124 is still off, indicating that an unwanted operating condition still exists, then at step 3 the controller 10 stops the motor 130, activates the alarm light 52 and sends a signal to the remote monitor (if a remote monitor is connected to the signal connectors 54, 55 of the controller).

The waiting period provided by the controller 10 ensures that the compressor 120 is in fact operating in an unwanted condition, and that the compressor sensor switch 124 is not simply being affected by a temporary condition. If, however, the compressor sensor switch 124 has switched on before expiration of the waiting period, then the controller 10 moves from step 2 back to step 1 to repeat the emergency stop feature if and when the compressor sensor switch switches off.

FIG. 6 illustrates the automatic drain feature of the controller 10. As is known, most compressor tanks are routinely flushed or drained to remove contaminants and moisture from the tank. The controller 10 according to the present invention, however, drains the tank 110 at regular intervals based upon cumulative compressor pumping time, as recorded by the cumulative compressor pumping time recorder 34, as opposed to intervals based upon actual time.

At step 1 of FIG. 6, the controller 10 initializes a pre-selected drain interval. Preferably, the pre-selected drain interval equals one hour of cumulative compressor pumping time. At any time during this automatic cycle, represented by step 2, a push button 31 on the controller panel can manually operate the drain solenoid valve 119 for test purposes or for activating a manual dump. The drain 119 is normally set to the open position until the push button 31 is closed. Manually operating the drain 119 does not reset the drain interval. At step 3, once the drain interval has expired, the controller 10 provides power to the drain solenoid valve 119, whereby the drain valve is opened and the tank 110 is drained. At step 4, the controller initializes a dump time, which is preferably equal to about five (5) seconds. Steps 3 and 4 occur essentially simultaneously once the run time has expired. Once the dump time expires at step 5, the power is shut off to the drain solenoid valve 119 such that the valve is closed. The controller 10 then returns to step 1 to repeat the automatic drain feature.

Use of the semi-automatic compressor controller described herein has the potential for creating significant savings. For a 25 HP, 2 stage reciprocating compressor operating 24 hours a day, 5 days a week during three shifts, wherein the first shift the compressor is operated at full load, the second shift at 40% load and the third shift at 20% load, an annual savings of $1339 is realized for an electric rate of $0.10/KWH.

Although the invention has been described with reference to a particular arrangement of parts, features and the like, this is not intended to exhaust all possible arrangements or features. Indeed, many other modifications and variations of the present invention will be ascertainable to those skilled in the art without departing from the spirit and scope of the present invention defined by the following claims.

What is claimed is:

1. A controller for a compressor system including a compressor, a motor for driving the compressor, an unloader for preventing the compressor from compressing gases, and a tank for receiving and storing compressed gases from the compressor, the controller comprising:

a start/stop control for starting the motor upon an internal pressure of the tank falling below a pre-selected low pressure level, and for stopping the motor upon the internal pressure of the tank rising above a pre-selected high pressure level;

a load/unload control for disabling the unloader upon the internal pressure of the tank falling below the pre-selected low pressure level, and for enabling the unloader upon the internal pressure of the tank rising above the pre-selected high pressure level, said load/unload control including a unload time dial operatively connected to the motor for setting a pre-selected unloading interval during which the motor runs while the unloader is enabled, the motor being shut-off upon expiration of said unloading interval if the internal pressure of the tank has not reached at least the pre-selected low pressure level;

a control switch for selecting one of the start/stop control and the load/unload control; and a drain control for opening a drain of the tank upon a pre-selected operating time of the compressor;

a drain control for pre-selecting cumulative operating time of the compressor and automatically opening a drain of the tank upon expiration of the pre-selected cumulative operating time of the compressor.

2. The controller of claim 1 further comprising a selector for allowing a user to select the unloading period.

3. The controller of claim 1 further comprising a pressure gauge for indicating the internal pressure of the tank.

4. The controllers of claim 1 wherein start/stop control and load/unload control each enables the unloader for a pre-selected delay period after starting the motor.

5. The controller of claim 1 operatively connected with the unloader further comprising a sensor operatively connected to the motor and detecting a pre-set value of a parameter selected from the group consisting of oil pressure, oil level and gas temperature or a combination thereof, the motor being shut-off in response to a signal generated by the sensor upon detecting the pre-set value.

6. The controller of claim 1 further comprising a drain control for opening a drain of the tank upon a pre-selected operating time of the compressor, the drain control including a manual override.

7. The controller of claim 1 further comprising a gauge for displaying the internal pressure of the tank.

8. A method for controlling a compressor system including a compressor, a motor for driving the compressor, an unloader for preventing the compressor from compressing gases, and a tank for receiving and storing compressed gases from the compressor, the method comprising the steps of:

measuring an internal pressure of the tank;

selectively operating the compressor in a start/stop mode, wherein during the start/stop mode the unloader is disabled and the motor is started upon the internal pressure of the tank falling below a pre-selected low pressure level and stopped upon the internal pressure of the tank rising above a pre-selected high pressure level, and a load/unload mode, wherein the motor is allowed to run and the unloader is disabled upon the internal pressure of the tank falling below the pre-selected low pressure level, and is enabled upon the internal pressure of the tank rising above the pre-selected high pressure level;

pre-setting an unloading interval to allow the internal pressure to reach the preselected low pressure level upon reaching the pre-selected high pressure;

stopping the motor upon expiration of the unloading interval if the internal pressure level has not reached the low pressure;

recording the cumulative operating time of the compressor; and draining the tank at pre-selected intervals of cumulative operating time.

9. A method according to claim 8 further comprising displaying the internal pressure of the tank.

10. A method according to claim 8 further comprising stopping the motor upon receiving an indication that a parameter selected from the group consisting of oil pressure, oil level and gas temperature or a combination thereof has reached a preselected value.

11. A method according to claim 10 further comprising signaling when the motor has been stopped.

12. A controller for a compressor system including a compressor, a motor for driving the compressor, an unloader for preventing the compressor from compressing gases, and a tank for receiving and storing compressed gases from the compressor, the controller comprising:

a start/stop control for starting the motor upon an internal pressure of the tank falling below a pre-selected low pressure level, and for stopping the motor upon the internal pressure of the tank rising above a pre-selected high pressure level;

a load/unload control for disabling the unloader upon the internal pressure of the tank falling below the pre-selected low pressure level, and for enabling the unloader upon the internal pressure of the tank rising above the pre-selected high pressure level, wherein the motor is stopped at a pre-selected unloading period after the unloader is enabled and the load/unload control is selected;

a control switch for selecting one of the start/stop control and the load/unload control; and a drain control including a recorder monitoring cumulative operating time, during which the compressor actually compresses gases, and automatically opening a drain of the tank upon expiration of a pre-selected cumulative operating time interval of the compressor.

13. The compressor defined in claim 12 wherein the drain control further has a manual override including a push button spaced from the tank and manually actuated to open a drain solenoid valve mounted on the tank before expiration of the pre-selected cumulative operating time to prevent accumulation of condensate.

14. The compressor defined in claim 13 wherein the push button is located on a control panel spaced at a distance form the tank, the operating time interval not being reset upon actuation of the push button.

* * * * *